US005245519A

United States Patent [19]

Openiano

[11] Patent Number: 5,245,519

[45] Date of Patent: Sep. 14, 1993

[54] MULTI-BRANCHED CHRISTMAS LIGHTS

[76] Inventor: Renato M. Openiano, P.O. Box 45156, San Diego, Calif. 92145

[21] Appl. No.: 837,854

[22] Filed: Feb. 18, 1992

Related U.S. Application Data

[63] Continuation-in-part of Ser. No. 697,229, May 6, 1991, abandoned.

[51] Int. Cl.[5] ..... F21P 1/02

[52] U.S. Cl. ..... 362/252; 362/249; 362/806

[58] Field of Search ..... 362/122, 249, 250, 251, 362/252, 253, 382, 397, 806, 807, 808

[56] References Cited

U.S. PATENT DOCUMENTS

| | | | |
|---|---|---|---|
| 1,843,389 | 2/1932 | Fischer | 362/249 |
| 2,047,045 | 7/1936 | Veenboer | 362/806 |
| 2,188,529 | 1/1940 | Corina | 362/123 |
| 2,453,695 | 11/1948 | Belling | 362/806 |
| 3,752,407 | 8/1973 | Baugh et al. | 362/806 |
| 4,782,434 | 11/1988 | Cole | 362/807 |
| 4,956,757 | 9/1990 | Wang | 362/252 |

*Primary Examiner*—Ira S. Lazarus
*Assistant Examiner*—Y. Quach
*Attorney, Agent, or Firm*—Fuess, Davidenas & Meadows

[57] ABSTRACT

An ornamental Christmas light decorating system containing one or more clusters of flashing lights, which can be shaped by a user and attached to various surfaces. The clusters provide a perception of directional movement or chasing of light.

18 Claims, 7 Drawing Sheets

FIG. 1
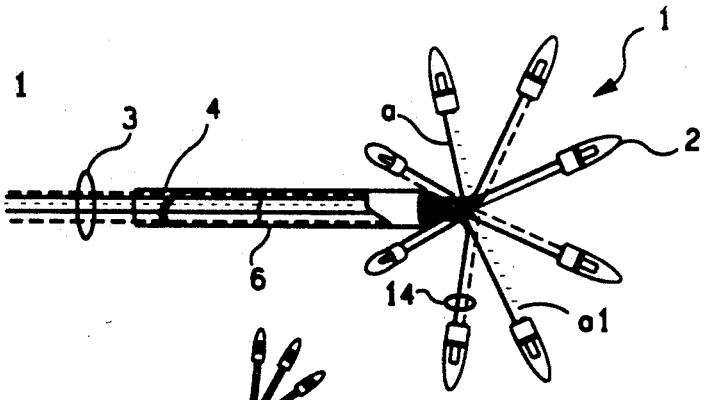
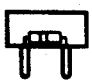
FIG. 1A
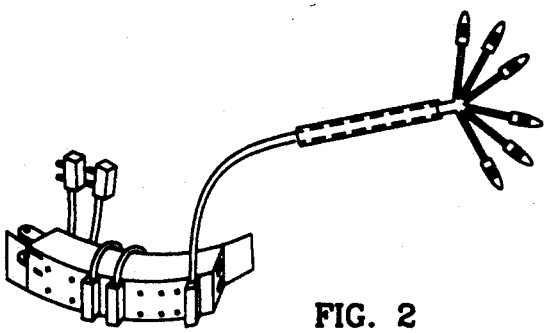
FIG. 2
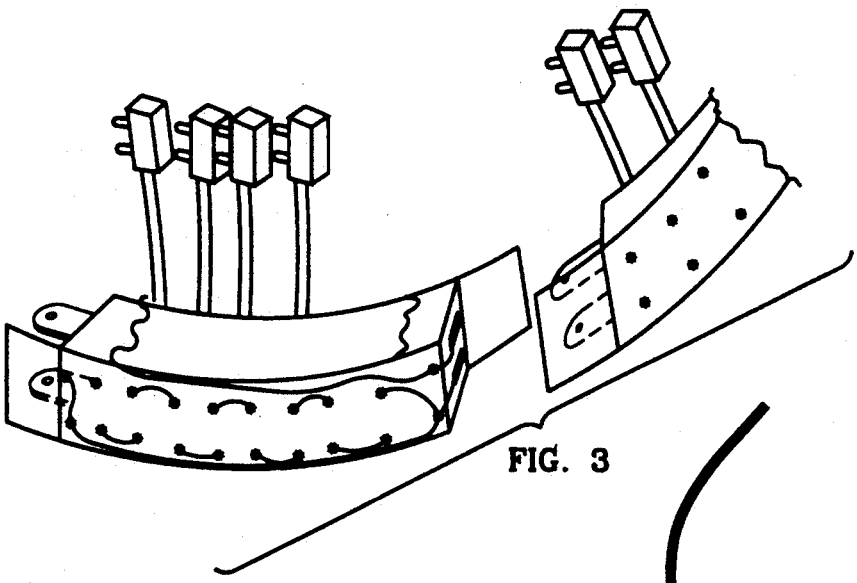
FIG. 3
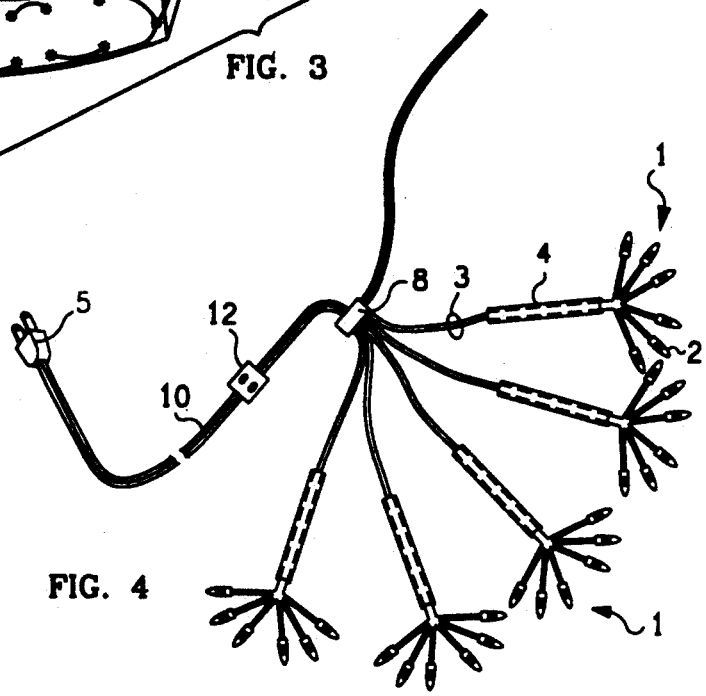
FIG. 4

MULTI-BRANCHED CHRISTMAS LIGHTS

CROSS REFERENCE TO RELATED APPLICATIONS

This application is a continuation-in-part of application Ser. No. 697,229 filed May 6, 1991 now abandoned, the disclosure of which is incorporated herein by reference.

BACKGROUND OF THE INVENTION

1. Technical Field

This invention relates to the field of decorative Christmas tree lights. More specifically it relates to an ornamental light system which is adjustable in size and shape by a user and which gives the perception of directional movement of light.

2. Description of the Background Art

Holiday season decorations used in the home or small business are generally limited by availability and cost to conventional non-flashing or randomly flashing lights commonly used for decorating indoor and outdoor trees. It would often be desireable to employ flashing lights that contain visually interesting patterns or sequences such as fading, chasing or flickering.

Positioning lights on trees, windows, or walls requires considerable skill and patience in order to avoid an unsightly conglomeration of tangled wires.

In U.S. Pat. No. 2,802,095, Denning describes a plastic or metal tree lighting bracket provided with decorative lights at spaced intervals along its length. The bracket is physically connected to tree limbs by flexible metal straps and bracket and branch are likewise supported from the tree trunk. The visual effect is a laterally extending branch with several lights spaced along its axis.

Canadian Patent No. 615,231, issued to Miller, describes a vertically elongate receptacle secured to the trunk of a tree. Individual electric conductors can be connected anywhere along the strip receptacle, permitting the routing of wires close to the branches.

Rhoades, in U.S. Pat. No. 4,462,065, describes an elongate tubular member mounted on a tree trunk that has a bracket at the top end receiving a plurality of light branches. Each light branch is constructed of an elongate rod having an electric cord with multiple lights attached. The visual effect is a number of strings of Christmas tree lights emanating from the trunk and following a curved path among the tree branches.

In U.S. Pat. No. 3,614,528, Craddock discloses an electrical circuit for periodically and essentially randomly flashing a plurality of gas discharge tubes in a Christmas tree light system Likewise, Chiang, in U.S. Pat. No. 4,713,586, describes a randomly flashing decorative light set, producing the visual effect of sparkling and twinkling. The light set accomplishes this effect without a long extending wire from an external power source.

What would be particularly useful is an adjustable system wherein a user can selectively design lighting effects, for example, the size of circles or other shapes. It would also be desireable to have a decorative lighting system that is not restricted to a tree, but could be displayed in windows, on walls, on tables, etc., much in the same manner as commercial decorative lighting. Such a system would need to be safe, easy to install and operate free of wire entanglement and inexpensive.

SUMMARY OF THE INVENTION

An inexpensive, adjustable, safe, and easy to install ornamental light system, uncluttered with multiple unsightly wires, is an objective of this invention.

In accordance with the present invention, one object is an ornamental light system comprising an elongate open-ended tubular member having a first end and a second end. A plurality of wires is slidingly mounted within the tubular member. Paired loops of each wire emerge from the first end of the member and dispose substantially, radially opposite relative to each other and perpendicularly to the axis of the member. Each wire loop is connected to an individual light to form paired individual lights dispose opposite each other in a radial pattern. Together, these loops with lights form a cluster containing a circular array of lights.

The circumference of a circle defined by the lights can be made larger or smaller by a user simply by varying the length of wire loop withdrawn from within the tubular member.

A controller is connected between the wires and an external source of electrical power for regulating flashing pattern and speed. Thus, each pair of lights flashes sequentially with other such light pairs, producing visual perception of circular movement of light.

Also contemplated is a light system wherein the first end of the tubular member is flared, having slots substantially equidistantly disposed peripherally around the flared end, and a cover plate for enclosing the flared open end. There may also be tubular conduit members extending radially from the slots of the flared end, each conduit member containing one wire loop taken from the plurality of wires.

In some cases it is advantageous to have a suction cup on the outer surface of the cover plate for attaching the light system cluster to smooth surfaces.

In a more preferred embodiment, the flared tubular member, conduit members and cover plate are integral, but axially divided, three-piece units that snap together after wires are placed therein.

Also contemplated is a system containing one or more junction boxes connected in series, each junction permitting connection of more than one of the cluster of lights in parallel or series.

The present invention is also concerned with an ornamental light system comprising a housing, which has an aperture as well as peripherally-arrayed plurality of apertures substantially equidistantly spaced. A plurality of wires ingress and egress through the aperture, and are slidingly mounted within the housing. Each single wire is formed into two loops, each loop egressing the housing through a peripheral aperture radially opposite from the other loop. Each wire loop is connected to an individual light, thereby resulting in a pair of oppositely radiating lights, forming a cluster containing an array of lights.

A controller, for regulating the flashing pattern and speed, is connected between the wires and an external source of electrical power, whereby, each pair of lights flashes sequentially with other such pairs, producing visual perception of planar light movement about a point in the center of the housing. An area of any geometric shape defined by the light movement can be increased or decreased by a user simply by varying the length of wire loop withdrawn from the housing. Provision is made for attaching the light system to surfaces.

In accordance with my teachings, the housing comprises a planar wall of any geometrical shape and a perpendicular wall running along its entire perimeter. The perpendicular wall contains a plurality of slots substantially equidistantly spaced around the perimeter. Centrally located in the planar wall is a circular aperture. There is also a planar cover having a mating face complementary in shape and dimensions formed by the perpendicular wall, and a complementary central aperture.

The cover is attached to the housing body by means of a tubular center guide that is comprised of a length of open-ended tubing with first and second ends. The first end is affixed to the planar wall at the central opening, the second end has two kerfs and a flange acting in concert as a detent for holding the cover in place.

In accordance with the present invention, the housing containing the wires therein can be cylindrical, cuboidal or rectangular in shape, or be of a non-planar, three-dimensional configuration having apertures in all surfaces. The wire loops with their individual lights can emerge from all faces or directions, producing a three-dimensional visual perception. Thus, for example, the housing can be of a spherical configuration.

In keeping with one of the preferred objects of this invention, the apertures have tubular conduit extensions radially disposed containing wire loops inside. The electrical wire bundles from the controller may ingress and egress through holes in the center guide and central opening of the planar wall.

Attachment of a light system cluster to smooth surfaces can be accomplished by any of well-known means, such as with a suction cup or a screw. To attach the light system cluster to another such cluster, a tubular conduit member of any desired length that will slip-fit into the central circular apertures can be used. In this manner, two or more of the clusters can be connected in series.

Similarly, a most preferred object of this present invention is an ornamental light system comprising a hollow housing containing a plurality of peripheral apertures substantially equidistantly spaced, and an integral flashing system.

The flashing system comprises a controller having a circuit board with a known computer chip for regulating the flashing pattern and sequence, and electrically connected wire loops with individual lights, which exit through the peripheral apertures.

An electrical lead wire, connectible to an external electricity source, is electrically connected to the controller. Provision is made for physically and electrically connecting the housing and flashing system components together.

In this particularly preferred embodiment, the hollow housing comprises a planar wall of any geometrical shape having a central aperture, a perpendicular peripheral wall containing the plurality of apertures equidistantly spaced, and a perpendicular interior wall affixed to the planar wall, circumscribing and flush with the aperture. The interior wall has an alignment slot and two electrical contact points on the inside surface. A cover for the housing with a mating surface complementary in shape and dimensions to those formed by the housing perpendicular wall is also provided.

The circuit board is mounted inside the housing, and is electrically connected to the contact points on the interior wall. One most preferred means for physically and electrically connecting the housing and flashing system components together employs a central core member, which fits snugly inside the aperture defined by the interior wall.

The core has two electrical contact points on its exterior surface which are complementary to the contact points on the housing interior wall. The core also has an alignment key, a flange for abutment to the housing planar wall on one end and a detent nose for fastening the cover on an opposite end. This embodiment also uses means such as a screw, suction cup or a tubular member to attach the system to surfaces or to other systems.

Certain advantages attach to this invention, namely, a) a user can select the size and shape of each cluster of decorative lights, and even alter or "fine-tune" his/her decorative effort to get desired effects, b) the ability to provide or change shapes, and the fact that the lights are capable of directed motion, provide interesting animation to the decorative effect, c) the effect is neat and organized, without wire clutter, and d) this ornamental lighting system is safe for inexperienced decorators to use, because it merely requires withdrawal of the desired amount of wire loop from its housing.

Still further embodiments and advantages of the invention will become apparent to those skilled in the art upon reading the entire disclosure contained herein.

BRIEF DESCRIPTION OF THE DRAWINGS

FIG. 1 is a plan view of an individual branch (hereinafter called cluster) of the ornamental lighting system.

FIG. 1A shows a dummy load in plan view.

FIG. 2 is a plan view of a single light cluster plugged into a substitution terminal block, along with two dummy loads.

FIG. 3 shows a pair of substitution terminal blocks in plan view with partial cutaway.

FIG. 4 diagrammatically shows an alternate embodiment wherein several clusters are connected in series or parallel in a junction box.

DETAILED DESCRIPTION OF THE PREFERRED EMBODIMENT

As illustrated generally in FIG. 1, the ornamental lighting system of the present invention comprises in general one or more clusters 1, each having an elongate open-ended tubular member such as 4 and a plurality of wires 3 (4 wires in this case) slidingly mounted within the tubular member. Paired loops (8 in this case) of each wire, e.g. $a,a_1$ emerge from the open end of the member and dispose substantially radially opposite, relative to each other and perpendicularly to the axis of the tubular member.

Figure 5:
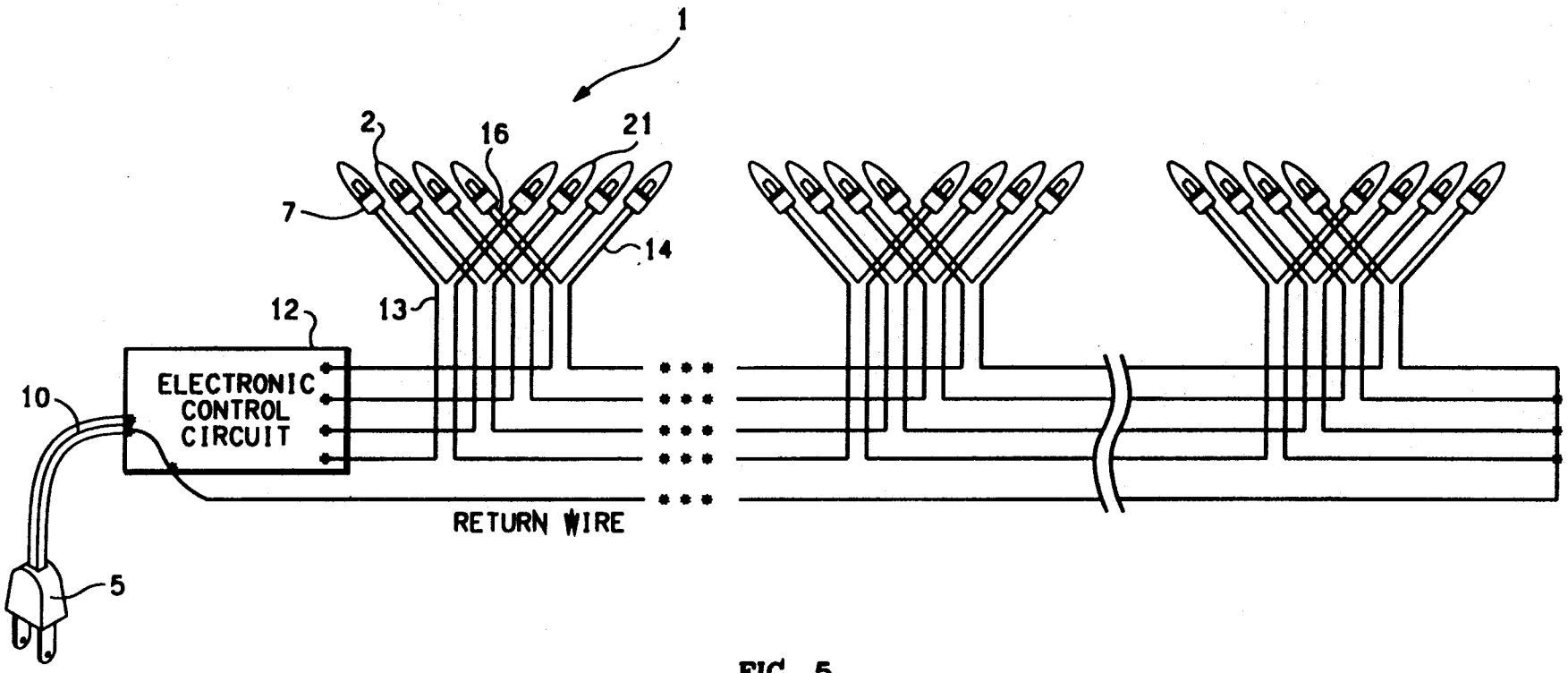
FIG. 5 is an electronic control circuit schematic of this invention.

Each wire loop is connected to an individual light means 2, comprised of a conventional socket and light bulb, to form paired individual light means disposed opposite each other in a radial pattern, together forming a cluster 1 containing a circular array of light means (see also FIG. 5). Note that excess lengths 6 of loop wires 14 are stored within the tubular member 4.

The circumference of a circle defined by the plurality of light means can be increased or decreased by a user by varying the length of wire loop 14 withdrawn from the tubular member 4.

As seen in FIGS. 1, 4, 6, 7, 8, and 13, the tubular member is open-ended for passage of wires, having a first end and a second end. In one embodiment, the first end is unmodified as shown in FIGS. 1 and 4, but it can be modified to end in a flare, as in FIG. 6, or even further modified to contain attached tubular conduit arms emanating laterally, as in FIG. 8.

Figure 6:
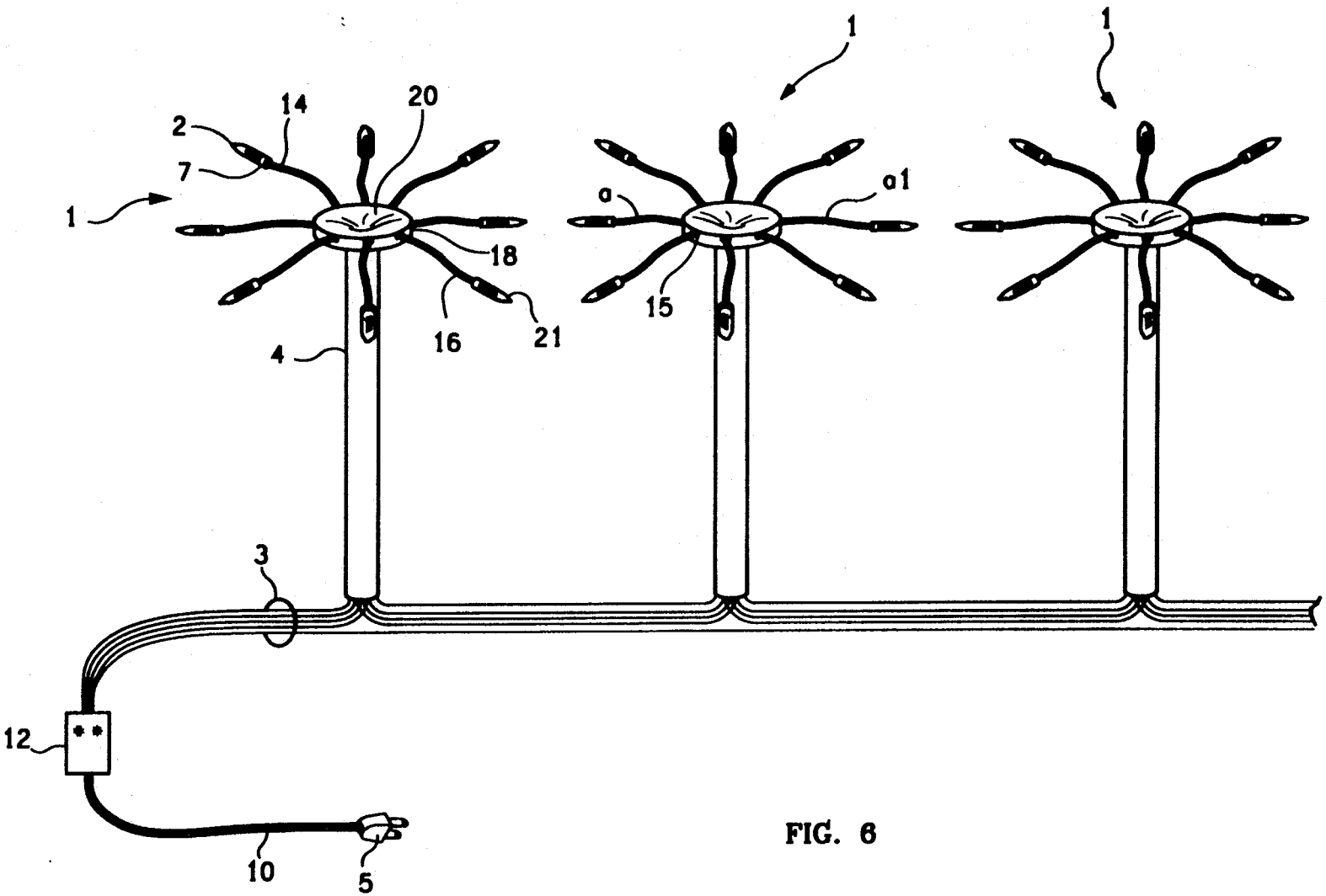
FIG. 6 shows three clusters connected in series of the system of this invention in perspective view.

As shown in FIGS. 4, 5 and 6, a controller means 12 is connected between the loop-forming wires and an external source of electrical power for regulating the flashing pattern and speed.

The schematic diagram in FIG. 5, shows the circuitry operational in the ornamental light system shown in FIG. 6. It can readily be seen how each wire is folded into two loops for each cluster 1, each loop 14 having a socket 7 and light bulb 2.

FIG. 6 illustrates how each loop is pulled through a slot, the matched pairs of loops $a$, $a_1$ egressing out of radially opposite slots. Each pair of light bulbs 2, $2_1$, shown in FIGS. 5 and 6, flashes simultaneously, but sequentially with other such light bulb pairs, producing visual perception of circular movement or chasing of light within a cluster 1. In this embodiment, the several clusters 1 are connected in series.

The clusters can also be connected in parallel as shown in FIG. 4. In that embodiment, one or more junction boxes 8 are connected in series, each junction permitting connection of more than one of the cluster of lights in parallel.

In a preferred embodiment, shown in FIG. 6, the first end of the tubular member is flared 18, having slots 15 substantially equidistantly disposed peripherally around the flared end, and a cover plate 20 for enclosing the flared open end. The cover plate 20 can have a suction cup, either attached or integrally constructed on its outer surface for attaching the light system cluster 1 to smooth surfaces such as, for example, window glass.

In an improved version of this embodiment (not depicted), short tubular conduit members are attached to and extend radially from the slots of the flared end, each conduit member containing one wire loop from the plurality of wires.

Figure 7:
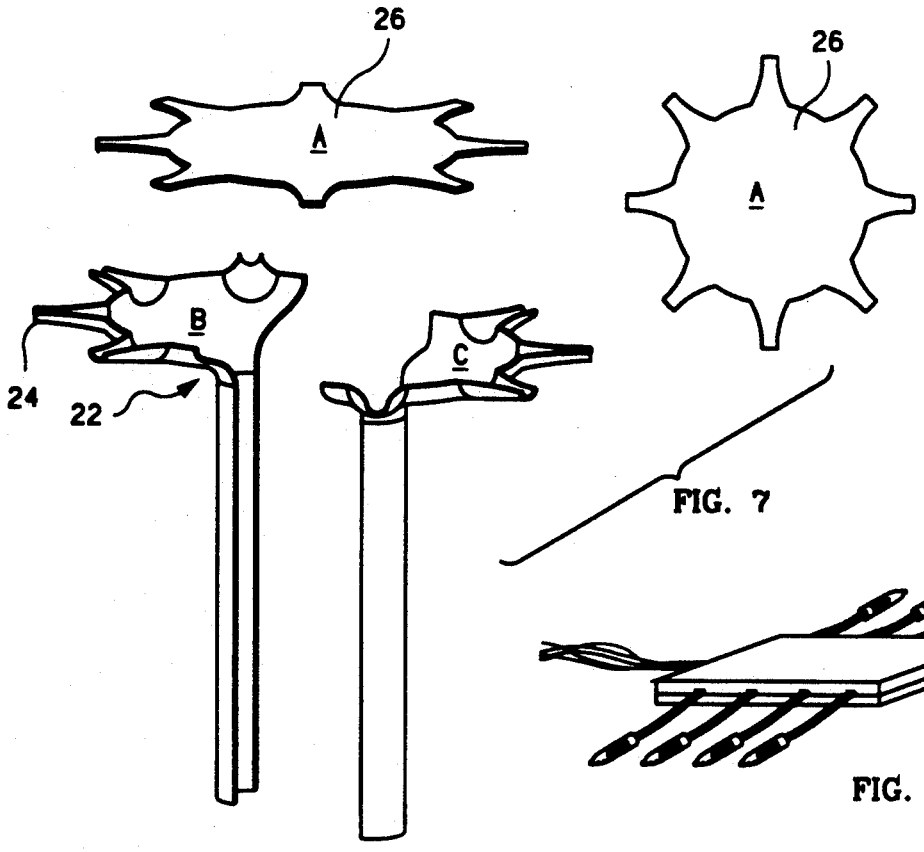
FIG. 7 is an exploded view of an improved tubular member.
Figure 14:
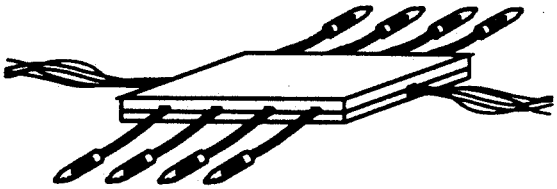
FIG. 14 depicts an alternate, rectangular housing.
Figure 8:
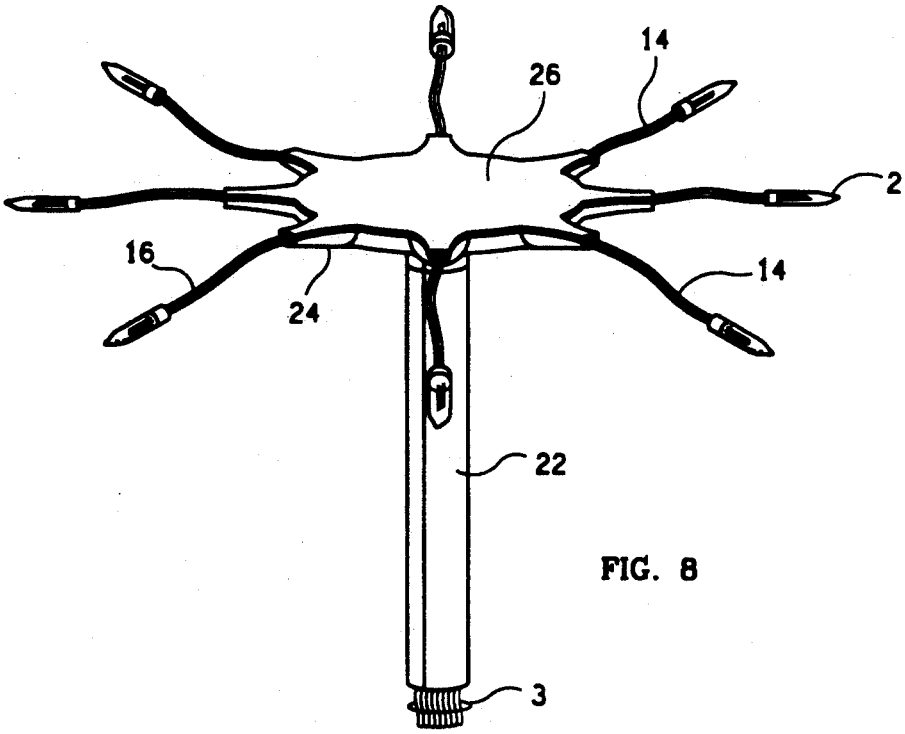
FIG. 8 shows the tubular member of FIG. 7 put together.
Figure 9:
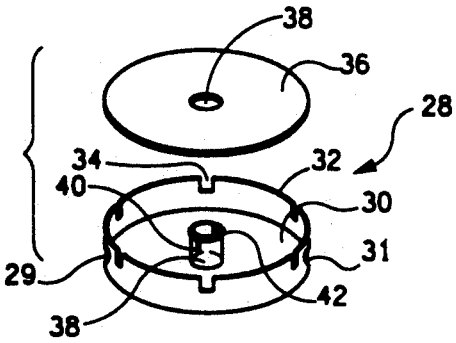
FIG. 9 depicts one embodiment of a housing of this invention in exploded view.

In a particularly preferred embodiment shown in FIG. 7, the flared tubular member 22, conduit members 24 and cover plate 26 are constructed as integral, but axially divided (tubular axis and perpendicular axis), three-piece units A, B, and C, that snap together, as in FIG. 8, by conventional means after placement of wires therein.

Another, more preferred embodiment of an ornamental light system is illustrated in FIGS. 9 through 13. This version comprises a housing 28, having at least one aperture 29 and a peripherally-arrayed plurality of apertures 34 substantially equidistantly spaced around the perimeter wall.

Although a cylindrical housing is shown in FIGS. 9 through 13, the housing 28 can comprise a planar wall 30 of any geometrical shape and a perpendicular wall 32 along its entire perimeter. The perpendicular wall contains a plurality of slots 34 substantially equidistantly spaced around the perimeter and a centrally located circular aperture 38 in the planar wall. A planar cover 36, has a mating face complementary in shape to the perpendicular wall outline and a complementary central aperture 38. A tubular center guide 39, comprised of a length of open-ended tubing with first and second ends, the first end is affixed t the planar wall 30 at the central aperture 38. The second end has two kerfs 40 and a flange 42 acting in concert as a detent for holding the cover in place.

Figure 10:
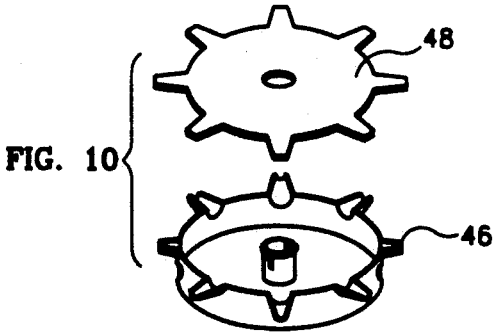
FIG. 10 shows an alternative, improved housing in exploded view.

An improved version of the housing 28 shown in FIG. 10 has lateral tubular conduit extensions 46 as integral units of a snap-together type of housing and cover 48 radially disposed.

Figure 11:
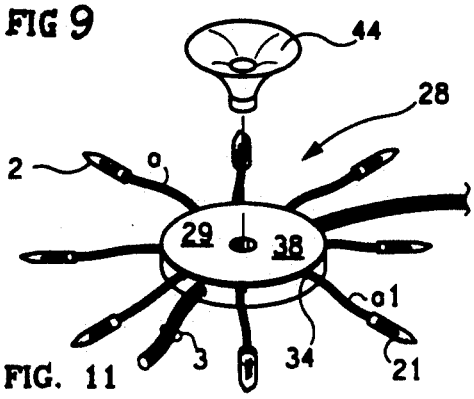
FIG. 11 shows a suction cup means of cluster attachment to smooth surfaces.

Focusing now on FIG. 11, a wire bundle comprising a plurality of wires 3, ingresses through the aperture 29, is slidingly mounted within the housing 28, and each single wire of the plurality of wires is formed into two loops as described hereinbefore. Each loop of the pair, e.g. $a$, egresses the housing through a peripheral aperture 34 radially opposite from the other loop $a_1$. Each wire loop is connected to an individual light means 2 as described before, thereby resulting in a pair of oppositely radiating light means $2,2_1$, forming a cluster containing an array of lights. Of course the electrical wires 3 can ingress and egress through holes in the center guide and central aperture 38 of the planar wall instead of through 29 and/or 31.

Figure 17:
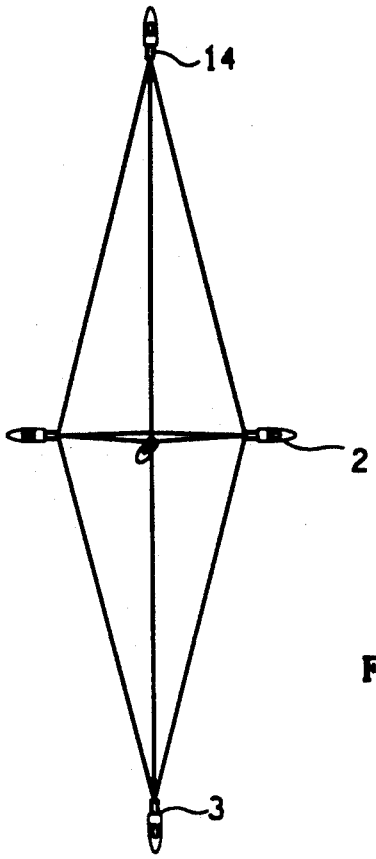
FIG. 17 is a housing of non-planar, three dimensional configuration having apertures in all surfaces, with the wire loops and lights emerging from all directions.
Figure 18:
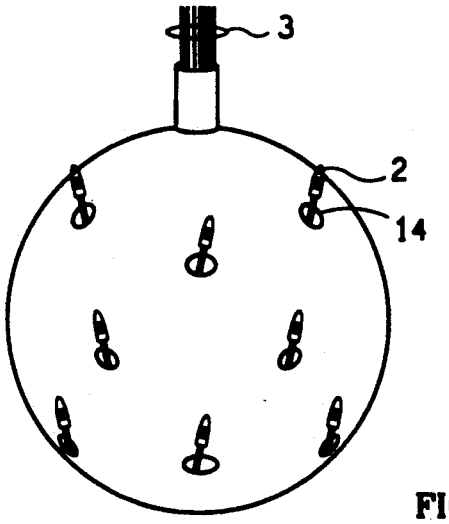
FIG. 18 is a housing of a spherical configuration.

It will be appreciated by those familiar with the field that the housing containing the wires therein can be of a non-planar, three-dimensional (FIG. 17) configuration having apertures in all surfaces, with the wire loops with lights emerging from all directions, and, thereby producing a three-dimensional visual perception. For example, the housing could be of a spherical configuration (FIG. 18).

Figure 12:
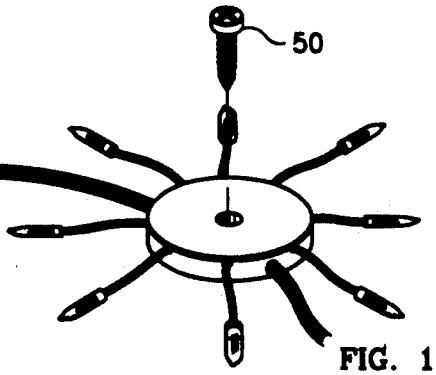
FIG. 12 shows cluster attachment by means of a screw.
Figure 13:
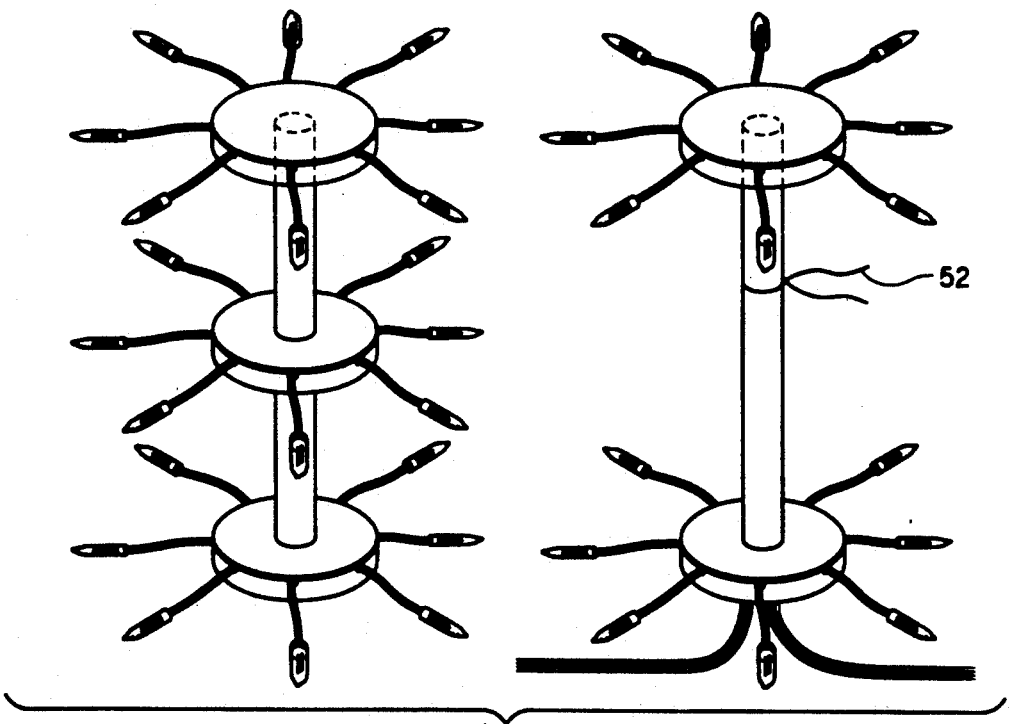
FIG. 13 shows multiple clusters connected in tandem.

As FIGS. 11 and 12 demonstrate, the light system cluster may be attached to smooth surfaces with a suction cup 44 slip-fitted into the central aperture 38. To attach the light system cluster to other surfaces a screw 50 may be used. To attach the light conduit member of any desired length that will slip-fit into the circular openings can be used. FIG. 13 illustrates how two or more of the clusters are connected in series.

Figure 15:
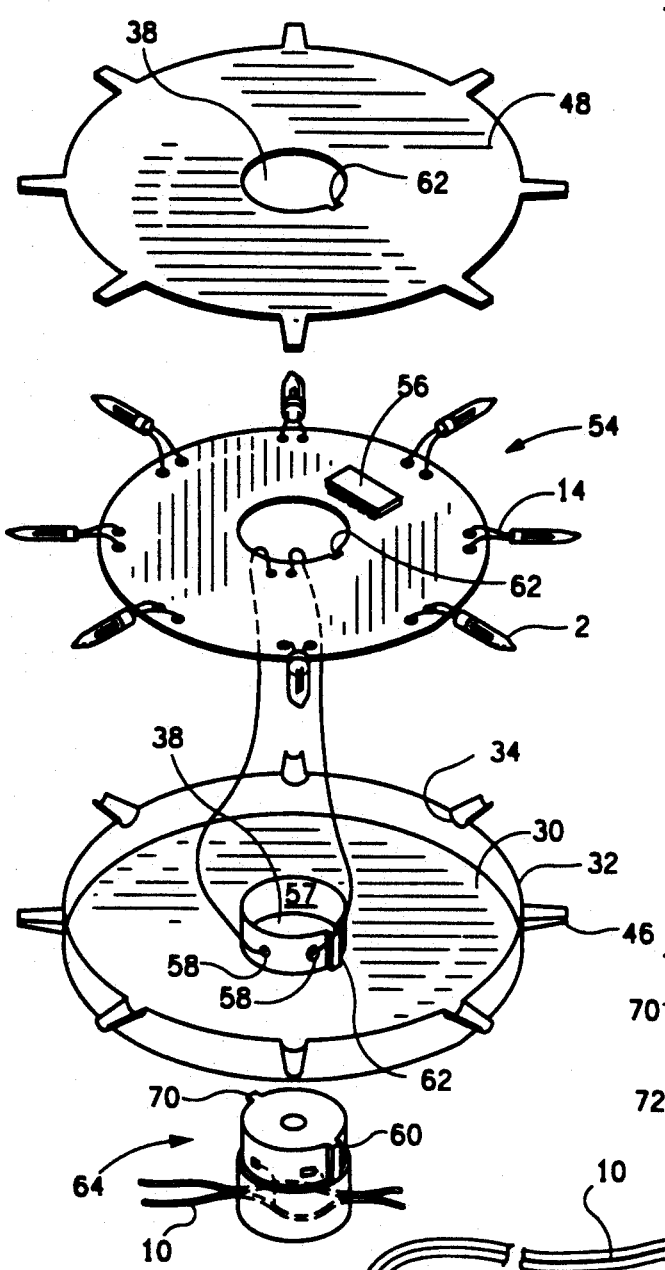
FIG. 15 is an exploded view of an improved ornamental light system cluster featuring an integrated controller.

Turning now to FIG. 15, an ornamental light system having an integrated controller in each light cluster is shown. As before, this embodiment has a hollow housing containing a plurality of peripheral apertures 34 substantially equidistantly spaced. An integral flashing system 54, comprising a circuit board with a known computer chip 56 for regulating flashing pattern and sequence is mounted inside the cluster housing and is connected to contact points 58 on the interior wall 57. Electrically connected wire loops 14 with individual lights 2 exit through the peripheral apertures 34.

The housing comprises a planar wall 30 of any geometrical shape and a central aperture 38, a perpendicular peripheral wall 32 containing the plurality of apertures 34 equidistantly spaced, a perpendicular interior wall 57 affixed to the planar wall 30, circumscribing and flush with the aperture, the interior wall having an alignment slot 62 and two electrical contact points 58 through the interior wall to the inside surface and a cover 48 for the housing with a mating surface complementary in shape and dimensions to the housing perpendicular wall. There is also an electrical lead wire 10, connectible to an external electricity source, electrically connected to the integral flashing system.

Figure 16:
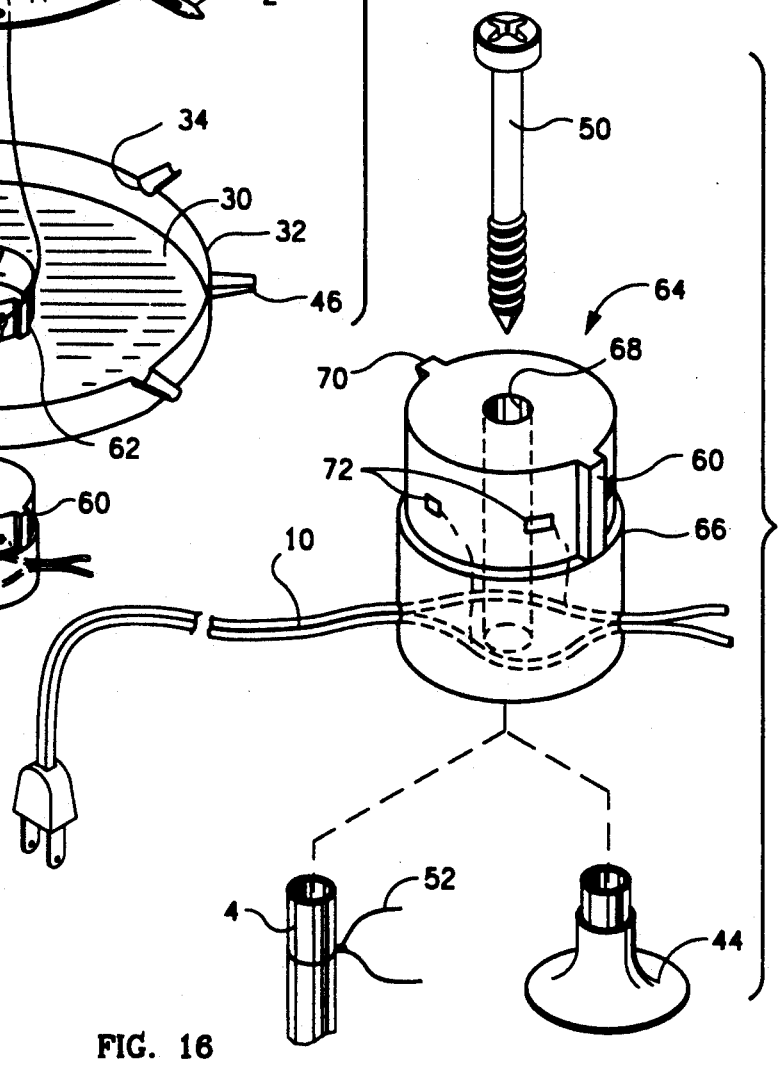
FIG. 16 is an exploded view of a core member of the cluster shown in FIG. 15, showing electrical connections and physical attachment means.

FIGS. 15 and 16 together show the means for physically and electrically connecting the housing 28 and flashing system 54 components together. The means comprises a central core member 64 which slip-fits inside the aperture 38 defined by the interior wall 57. The central core member has two electrical contact points 72 on its exterior surface complementary to the contact points 58 on the housing interior wall 57. Proper alignment is assured by an alignment key 60 and slot 62, and a flange 66 for abutment to the housing planar wall 30 on one end and a detent nose 70, for fastening the cover 48, on the opposite end. Attachment to surfaces and other clusters is provided by suction cup 44, screw 50, or tubular member 4, with tie 52, or without. It will be appreciated that many other securing means are known to those in the field, and are contemplated herein.

Although the present invention has now been described in terms of certain preferred embodiments, and exemplified with respect thereto, one skilled in the art will readily appreciate that various modifications, changes, omissions and substitutions may be made without departing from the spirit thereof. It is intended, therefore, that the present invention be limited solely by the scope of the following claims.

What is claimed is:

1. An ornamental light system, comprising:

a housing;

a plurality of wires slidingly mounted within said housing, paired loops of each wire emerging from said housing and disposing substantially opposite relative to each other, each wire loop connected to an individual light means to form paired individual light means disposed opposite each other in a divergent pattern, the individual light means together forming a cluster, wherein a perimeter of a geometric shape defined by said light means can be increased, decreased or geometrically altered by a user by varying the length of wire loop withdrawn from said housing;

a controller means connected between said plurality of wires and an external source of electrical power for regulating flashing pattern and speed;

wherein each light means pair flashes sequentially with other such light means pairs, producing a visual perception of circular movement of light.

2. The ornamental light system according to claim 1, wherein said housing comprises:

an elongate open-ended tubular member having a first and a second end;

wherein said paired wire loops emerge radially from said first end to shape the cluster of individual light means as a circular array.

3. The ornamental light system according to claim 2, wherein said first end of said elongated open-ended tubular member is flared, having slots substantially equidistantly disposed peripherally around said flared first end, and a cover plate for enclosing said flared first end.

4. The ornamental light system according to claim 3 further comprising:

tubular conduit members extending radially from said slots of said flared first end, each conduit member containing one wire loop from said plurality of wires.

5. The ornamental light system according to claim 4, wherein said flared elongated open-ended tubular member, conduit members and cover plate are integral, but axially divided, three-piece units that snap together after placement of wires therein.

6. The ornamental light system according to claim 3, wherein said cover plate has a suction cup on its outer surface for attaching said cluster of individual light means to smooth surfaces.

7. The ornamental light system according to claim 1 further comprising one or more junction means connected in series, each junction means permitting connection of more than one said cluster of individual light means in parallel.

8. An ornamental light system, comprising:

a housing, having and defining both (i) an aperture and (ii) a peripherally-arrayed plurality of apertures substantially equidistantly spaced;

a plurality of wires, ingressing and egressing through said aperture, slidingly mounted within said housing, each single wire formed into two loops, a first one of the two loops egressing said housing through a one of the plurality of peripherally-arrayed apertures, that is substantially opposite from a one of the peripherally-arrayed apertures through which egresses the other one of the two loops, each wire loop connected to an individual light means so as to position a plurality of individual light means in a cluster;

a controller means connected between said plurality of wires and an external source of electrical power for regulating a flashing pattern and speed, wherein each light means pair flashes sequentially with other such light means pairs, producing a central visual perception of planar light movement about a point of said housing, wherein an area of any geometric shape defined by said planar light movement can be increased or decreased by a user by varying the length of wire loop withdrawn from said housing;

means to attach said ornamental light system to surfaces.

9. The ornamental light system according to claim 8, wherein said housing further comprises:

a planar end wall of any geometrical shape and a side wall along its entire perimeter, said side wall containing a plurality of apertures substantially equidistantly spaced along said perimeter, and a centrally located aperture in said planar end wall;

a planar cover having a mating face complementary to an unattached end of said side wall, and a central aperture complementary to said centrally located aperture in said planar end wall; and a tubular center guide means to attach said planar cover, comprised of a length of open-ended tubing with first and second ends, said first end being affixed to said planar end wall at said centrally located aperture, said second end having two kerfs and a flange acting in concert as a detent in said complementary central aperture for holding said planar cover in place.

10. The ornamental light system according to claim 9, wherein said plurality of wires ingress and egress through holes in said tubular center guide means and centrally located aperture of said planar end wall.

11. The ornamental light system according to claim 8, wherein said housing containing said plurality of wires therein is cylindrical in shape.

12. The ornamental light system according to claim 8, wherein said housing containing said plurality of wires therein is of a non-planar, three-dimensional configuration having apertures in all surfaces, said wire loops with lights emerging from all directions, producing a three-dimensional visual perception.

13. The ornamental light system according to claim 12, wherein said housing is of a spherical configuration.

14. The ornamental light system according to claim 8, wherein said means to attach said individual light means cluster to smooth surfaces is a suction cup.

15. The ornamental light system according to claim 8, wherein said means to attach said individual light means cluster to surfaces is a screw.

16. The ornamental light system according to claim 8, wherein said peripherally-arrayed plurality of apertures have tubular conduit extensions radially disposed.

17. The ornamental light system according to claim 9, wherein said means to attach said individual light means cluster to another such cluster is a tubular conduit member of any desired length that will slip-fit into said central apertures.

18. The ornamental light system according to claim 8, wherein two or more of said clusters are connected in series.

* * * * *